US005228561A

United States Patent [19]

Schroeder et al.

[11] Patent Number: 5,228,561

[45] Date of Patent: Jul. 20, 1993

[54] LONG TRAVELING BUTTON SWITCH WITH ENHANCED USER FEEDBACK

[75] Inventors: Christopher K. Schroeder; Curt N. Torgerson, both of San Diego, Calif.

[73] Assignee: Hewlett-Packard Company, Palo Alto, Calif.

[21] Appl. No.: 680,609

[22] Filed: Apr. 1, 1991

Related U.S. Application Data

[63] Continuation of Ser. No. 419,032, Sep. 27, 1989, abandoned.

[51] Int. Cl.[5] ..... H01H 1/10; H01H 1/02

[52] U.S. Cl. ..... 200/517; 200/511; 200/512; 200/515

[58] Field of Search ..... 200/517, 511, 512, 515, 200/516, 520, 521, 534

[56] References Cited

U.S. PATENT DOCUMENTS

| | | | |
|---|---|---|---|
| 3,668,356 | 6/1972 | Kekas | 200/172 A |
| 4,496,803 | 1/1985 | Smith | 200/5 A |
| 4,527,030 | 7/1985 | Oelsch | 200/515 |
| 4,528,431 | 7/1985 | Coleman, III | 200/408 |
| 4,529,848 | 7/1985 | Cherry | 200/517 |
| 4,605,828 | 8/1986 | Gostomski, Jr. et al. | 200/517 X |
| 4,659,881 | 4/1987 | Dowe | 200/517 X |
| 5,057,657 | 10/1991 | Skulic | 200/521 |
| 5,066,842 | 11/1991 | Yamagata | 200/520 |

FOREIGN PATENT DOCUMENTS

| | | | |
|---|---|---|---|
| 8105649 | 2/1981 | Fed. Rep. of Germany . | |
| 8401137 | 1/1984 | Fed. Rep. of Germany . | |
| 48812 | 12/1988 | Japan | 500/517 |

*Primary Examiner*—Henry J. Recla
*Assistant Examiner*—David J. Walczak
*Attorney, Agent, or Firm*—David S. Romney

[57] ABSTRACT

A pushbutton switch including a keycap having a keycap top and a keycap plunger, a retaining bezel for guiding the keycap plunger and limiting the displacement thereof, a deformable elastomeric switch button supporting a contact pad, and a printed circuit contact pattern engageable by the contact pad when the switch button is deformed by the downward displacement of the keycap plunger. The deformation of the button switch provides tactile feedback, while impact of the keycap top against the retaining bezel provides audible feedback. The pushbutton switch is configured to limit the downward displacement of the keycap plunger to avoid excessive force on the printed circuit board.

7 Claims, 2 Drawing Sheets

LONG TRAVELING BUTTON SWITCH WITH ENHANCED USER FEEDBACK

This is a continuation of copending application Ser. No. 07/419,032 filed on Sep. 27, 1989, now abandoned.

BACKGROUND OF THE INVENTION

The disclosed invention is directed generally to a keyboard pushbutton switch, and more specifically is directed to a keyboard pushbutton switch having a long travel, and enhanced tactile and audible feedback, and improved contact reliability.

Pushbutton switches are utilized in keyboards for calculators, device control panels, and the like. A known pushbutton switch structure includes a dome-shaped metallic contact which contactively engages contacts on a printed circuit board when deformed by actuation of an associated keycap. The deformation of the metallic dome provides both tactile feedback and audible feedback.

An important consideration with a pushbutton switch having a metallic dome contact is the relatively small contact area provided by the deformed dome, which makes such switches susceptible to non-closure due to dust and dirt contamination. In order to increase reliability, some metallic dome pushbutton switches are individually packaged for insertion in printed circuit boards. Such switches can be more expensive and bulkier.

Another consideration with metallic dome pushbutton switches is transmission of the keypress force to the printed circuit board, which if excessive could cause damage.

A further consideration with pushbutton switches having metallic dome contacts is a limitation on the amount of key travel imposed by the metallic dome. Relatively longer key travel provides for a more comfortable keypress.

SUMMARY OF THE INVENTION

It would therefore be an advantage to provide a keyboard pushbutton switch structure having a reliably large contact area.

Another advantage would be to provide a keyboard pushbutton switch structure which reduces the amount of keypress force transmitted to the printed circuit board utilized therewith.

A further advantage would be to provide a keyboard pushbutton switch structure which provides for sufficient key travel.

The foregoing and other advantages are provided by the invention in a pushbutton switch structure that includes a manually depressable keycap having a keycap top and a keycap plunger, a resiliently deformable elastomeric switch button aligned with and engageable by the keycap plunger, a contact pattern supported on a printed circuit board located beneath the switch button, a contact element supported by the deformable switch button for contacting the contact pattern pursuant to deformation of the deformable switch button by downward displacement of the keycap plunger, and a retaining bezel for guiding and limiting the displacement of the keycap plunger. The deformation of the button switch provides tactile feedback, while impact of the keycap top against the retaining bezel provides audible feedback.

BRIEF DESCRIPTION OF THE DRAWING

The advantages and features of the disclosed invention will readily be appreciated by persons skilled in the art from the following detailed description when read in conjunction with the drawing wherein.

DETAILED DESCRIPTION OF THE DISCLOSURE

Figure 2:
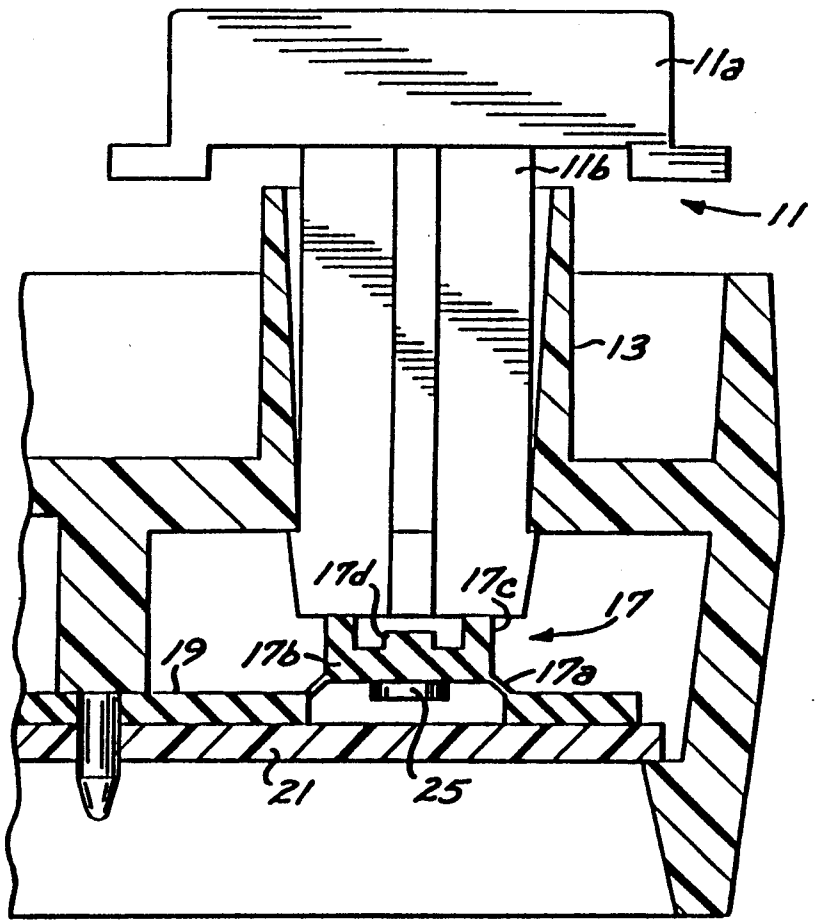
FIG. 2 is an elevational sectional view illustrating the pushbutton switch of FIG. 1 with the keycap plunger in the non-actuated position and exerting a slight preload on the switch dome.

In the following detailed description and in the several figures of the drawing, like elements are identified with like reference numerals.

Figure 1:
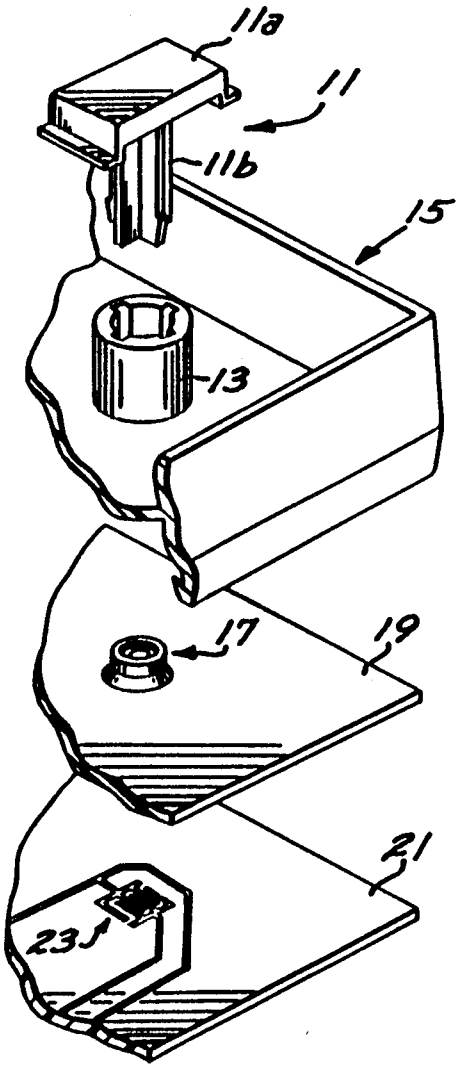
FIG. 1 is a schematic exploded perspective illustration of a pushbutton switch in accordance with the invention.

Referring now to FIG. 1, shown therein is a pushbutton switch assembly that includes a keycap 11 having a keycap top 11*a* and a keycap plunger 11*b*. The keycap plunger 11*b* is slidably engaged and retained in a guiding and retaining bezel 13 which, for example, is integrally formed with other bezels in a bezel structure 15. By way of example, the keycap plunger includes barb-like tabs for engaging the bottom portions of the bezel 13 to limit the upward displacement of the keycap.

An elastomeric dome switch button 17 is located beneath the keycap 11. By way of example, the switch button 17 is integrally formed in an elastomeric sheet 19, comprising rubber, for example, with other switch buttons. The elastomeric sheet 19 rests on a printed circuit board 21 having a conductive pattern 23 aligned with the switch button 17. By way of example, the conductive pattern 23 can comprise interleaved conductive traces to provide redundant contact elements. The printed circuit board 21 is attached to the bezel structure 15 to prevent relative displacement thereof.

The elastomeric dome switch button 17 comprises a conical side wall 17*a* secured to the elastomeric sheet 19 at its lower boundary. A horizontal top wall 17*b* is formed on the upper boundary of the conical side wall 17*a*, and a circular ridge 17*c* is formed on the top wall 17*b*. A cylindrical bump 17*d* of shorter height than the circular ridge 17*c* is formed in the center of the top wall 17*b*. The thicknesses of the top wall 17*b*, the circular ridge 17*c*, and the central bump 17*d* are greater than the thickness of the conical side wall so that the conical side wall resiliently deforms more easily than the thicker elements.

A conductive pad 25, comprising, for example, a carbon impregnated elastomer, is attached to the underside of the top wall 17*b* generally in alignment with the bump 17*c*.

The keycap 11, the bezel 13, and the bezel structure 15 are configured to provide a slight preload on the switch button 17 when the keycap 11 is not actuated, as shown in FIG. 2. Further, the keycap 11 and bezel 13 are configured so that the bottom of the keycap top is against the top of the bezel 13 when the switch button 17 is fully deformed, which transfers further force to the bezel 13.

Figure 3:
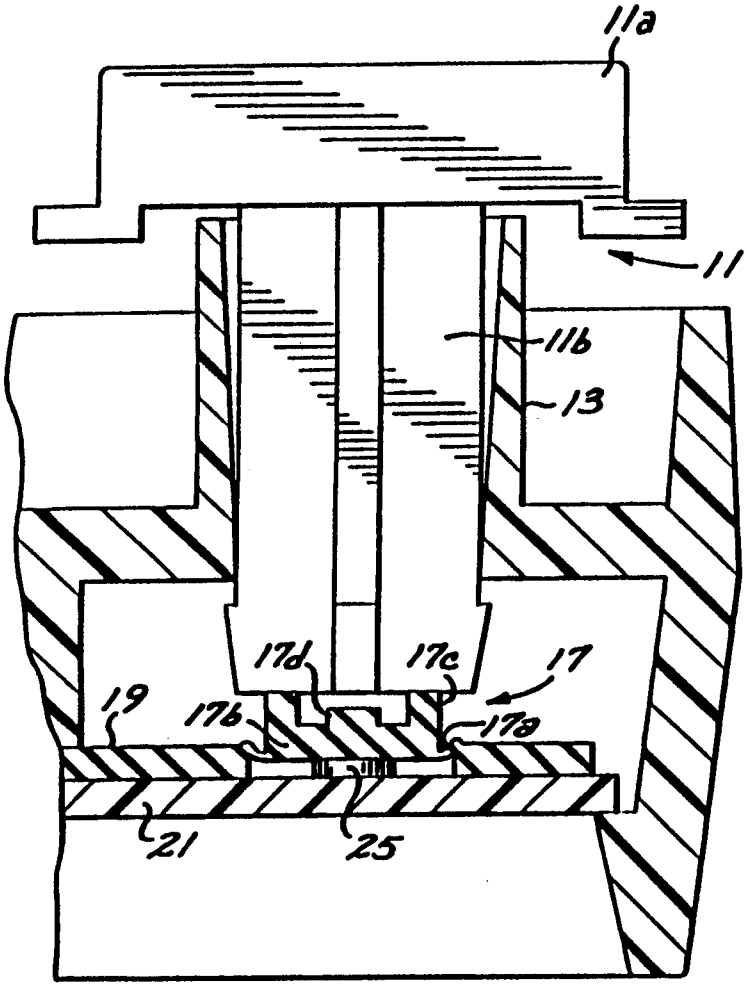
FIG. 3 is an elevational sectional view illustrating the pushbutton switch of FIG. 1 with the keycap plunger sufficiently displaced to cause deformation of the switch dome and contactive closure of the switching elements.

The pushbutton switch operates as follows. The user presses the top of the keycap top 11*a* to displace the keycap 11 downwardly. The conical side wall 17*a* collapses just before the contact pad 25 engages the conductive pattern 23 on the printed circuit board, which causes a distinct variation in the resistance felt by the user's finger. In particular, the sudden collapse of the conical side wall 17*a* reduces the resistance on the keycap which, pursuant to the keypress force, then travels quickly to impact the bezel 13 and produce an audible feedback click. FIG. 3 shows the contact pad 25 against the conductive pattern 23 just after the conical side wall has collapsed, and FIG. 4 shows the keycap at its downward travel limit against the bezel 13.

Figure 4:
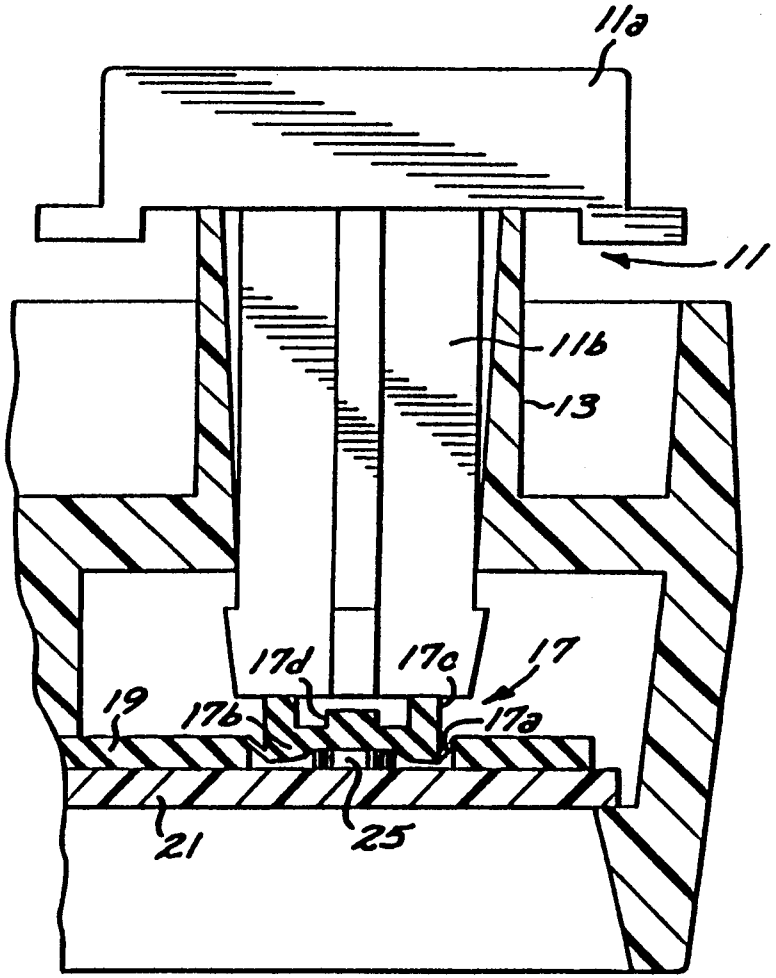
FIG. 4 is an elevational sectional view illustrating the pushbutton switch of FIG. 1 with the keycap plunger sufficiently displaced to cause audible feedback from the impact of the keycap top on the retaining bezel.

As particularly shown in FIG. 4, when the keycap 11 is fully depressed against the bezel 13, the side wall 17*a* is collapsed, and the top wall 17*b* is slightly deformed around the contact pad 23, but does not touch the printed circuit board 19. Any keypress force applied to the keycap beyond that required to collapse the side wall 17*a* and deform the top wall as shown in FIG. 4 will be transmitted to the bezel 13 and not to the printed circuit board 19. In particular, the keycap 11, the bezel 13, and the switch button 17 are configured so that a limited amount of force is transmitted to the printed circuit board, for example, an amount determined to be sufficient to assure appropriate contact between the contact pad 25 and the conductive pattern 23. In this manner, contact is assured while preventing excessive forces on the printed circuit board 21.

The keycap travel and the nature of the tactile feedback are selected to provide for a comfortable keypress that provides a distinct indication that contact has been made.

The keycap travel is determined by the difference between (a) the top to bottom height of the retaining bezel 13, and (b) the distance on the keycap plunger 11*b* between the barb-like tabs and the underside of the keycap top 11*a*. In conjunction with selection of keycap travel, the distance between the contact pad 23 and the printed circuit conductive pattern should be selected so that appropriate contact is assured while avoiding the application of excessive force when the keycap is fully depressed.

The nature of the tactile feedback, which is the force-to-displacement characteristic of the switch button 17, is determined by the thickness of the conical sidewall 17*a*, the thickness of the top wall 17*b*, the outside diameter of the top wall 17*b*, and the inside diameter of the lower boundary of the conical sidewall 17*a*.

The foregoing has been a disclosure of a pushbutton switch assembly that advantageously utilizes elastomeric switch buttons and provides tactile feedback as well as mechanically produced audible feedback. Further, the disclosed pushbutton switch allows for implementation of an appropriate comfortable keycap travel.

Although the foregoing has been a description and illustration of specific embodiments of the invention, various modifications and changes thereto can be made by persons skilled in the art without departing from the scope and spirit of the invention as defined by the following claims.

What is claimed is:

1. A pushbutton control which is manually depressible to cause current flow between two conductive contacts on a printed circuit board, comprising:

central plunger means having an upper end, a lower end, a keycap on its upper end and a stop member on its lower end, for manually controlling the current flow;

an outer guide member adapted to be mounted to said printed circuit board and; slidingly receiving said central plunger means, said outer guide member engageable with said stop member of said central plunger to limit the upward movement of said keycap;

an elastomeric dome switch under the lower end of said central plunger means and having circular ridge means for contacting said lower end of said central plunger mans, said elastomeric dome switch carrying a conductive pad in alignment with said central plunger means and which is to be in alignment with the two conductive contacts on the printed circuit board;

impact means on said outer guidemember for limiting the downward movement of said keycap after said conductive pad has electrically connected together the two conductive contacts on the printed circuit board; and wherein said elastomeric dome switch includes central wall means having said circular ridge means formed on an upper periphery of said central wall means and having conical side wall means formed on a lower periphery of said central wall means, said central wall means having a thickness greater than said conical side wall means, said conical side wall means having sufficient strength to hold said central plunger means in a first non-depressed position for holding said conductive pad spaced above the two conductive contacts, said central wall means having sufficient strength for holding said conductive pad against the two conductive contacts when said central plunger is manually moved to a second depressed position after manual pressure on the keycap causes collapse of said conical side wall means, said conical wall means stretching toward the circuit board and said central wall means flexing toward the circuit board when said central plunger is manually moved to a third final position wherein said impact means contacts said keycap to avoid excessive pressure on the printed circuit board, and wherein said collapse of said conical wall means and said contacting of said impact means with said keycap provides tactile and audible feedback.

2. The pushbutton control of claim 1 wherein said elastomeric dome switch is partially displaced downwardly when said central plunger is in said first non-depressed position, in order to preload said central plunger and its keycap and provide a threshold resistance to any initial actuation of the pushbutton control, thereby enhancing the tactile feedback.

3. The pushbutton control of claim 1 wherein said central wall means includes an enlarged central bump having a height shorter than said circular ridge means.

4. The pushbutton control of claim 1 wherein said conical side wall means has a peripheral diameter which is greater than a peripheral diameter of said central wall means.

5. The pushbutton control of claim 4 wherein said conical side wall means is sufficiently thin and sufficiently flexible to produce a sudden reduction in resistance when said central plunger is moved out of said first non-depressed position, and to produce a continued reduction in resistance when said central plunger is moved through said second depressed position to said third final position, thereby providing enhanced tactile and audible feedback.

6. The pushbutton control of claim 1 wherein said lower end of said central plunger includes multiple projections which extend across said circular ridge means.

7. The pushbutton control of claim 1 wherein said elastomeric dome switch is integrally connected to an elastomeric sheet with a thickness greater than the thickness of said conical side wall means, and wherein an outer periphery of said conical side wall means provides the connection of said elastomeric dome switch to said elastomeric sheet.

* * * * *